United States Patent [19]

Schoppe

[11] 3,995,952

[45] Dec. 7, 1976

[54] SHEET FEEDING APPARATUS

[75] Inventor: Wayne F. Schoppe, Webster, N.Y.

[73] Assignee: Xerox Corporation, Stamford, Conn.

[22] Filed: Mar. 1, 1976

[21] Appl. No.: 662,747

[52] U.S. Cl. ..... 355/3 R; 271/34; 271/122

[51] Int. Cl.[2] ..... G03G 15/00

[58] Field of Search ..... 271/34, 35, 122, 125; 355/3

[56] References Cited

UNITED STATES PATENTS

| | | | |
|---|---|---|---|
| 3,198,514 | 8/1965 | Barbera | 271/34 X |
| 3,768,803 | 10/1973 | Stange | 271/34 |

*Primary Examiner*—Richard A. Schacher

*Attorney, Agent, or Firm*—James J. Ralabate; Clarence A. Green; Paul Weinstein

[57] ABSTRACT

A friction retard sheet feeding apparatus including a feed member for engaging a stack of sheets and a retard member having a friction surface arranged in nipped engagement with the feed member. The sheets are supported in a stack configuration upon an elevator arranged for movement between an elevated position for sheet feeding and a lowered position. Drives are provided to raise the elevator. An incrementing apparatus is provided for advancing the retard member relative to the feed member in response to the operation of the drives for elevating the stack.

9 Claims, 11 Drawing Figures

SHEET FEEDING APPARATUS

CROSS REFERENCE TO RELATED APPLICATION

U.S. application, Ser. No. 662,383, filed of even date herewith, for a stack elevating apparatus, to Taylor et al.

BACKGROUND OF THE INVENTION

This invention relates to a sheet feeding apparatus of the friction retard type. An advanceable retard member is arranged in a nipped configuration with a feed member with the sheets passing therebetween. In accordance with this invention, an apparatus is provided for incrementally advancing the retard member in response to the operation of a drive system associated with a sheet stack elevating mechanism.

A wide veriety of friction retard type sheet feeding and separating apparatuses are known in the art. U.S. Pat. Nos. 3,035,834 to Bottrell; 3,198,514, to Barbera et al.; 3,260,520 to Sugden; and 3,635,465 to Beery are exemplary of a large number of patents disclosing moving belt type retard members which are moved in either the sheet feeding direction or counter thereto. U.S. Pat. Nos. 3,892,629 to Osgood et al. and 1,955,066 to Hiller are exemplary of patents disclosing the use of moving retard rolls in a friction retard separator.

U.S. Pat. No. 3,768,803 to Stange is particularly relevant insofar as it describes, particularly by reference to FIG. 16 thereof, the use of a belt type retard member which may be either continuously or incrementally advanced. The retard belt is arranged in association with a feed belt and deformably engages the feed belt in an unsupported section to form a nip for sheet advancement therebetween.

It has been found desirable in accordance with the present invention to provide an apparatus for incrementing a retard member such as a web, belt or roll, which conserves power, which is low cost and which provides improved wearing of the friction surface of the member. It has further been found desirable to preferably provide non-uniform incrementation of the retard member which should further improve the wearing of the friction retard surface.

SUMMARY OF THE INVENTION

It is proposed to accomplish these aims in accordance with the present invention by providing an improved retard member incrementing apparatus for a sheet separator and feeder.

The apparatus includes a friction retard means for feeding sheets from a stack thereof. The feeding means includes a feed member for engaging the stack and a retard member having a friction surface arranged to engage the feed member to form a nip through which the sheets are fed. Means are provided for supporting the stack of sheets for movement between at least one elevated position and a lowered position and for selectively driving the stack support means to the elevated position.

In response to the operation of the selective driving means, means are provided for incrementally moving the retard member relative to the feed member. Thereby upon movement of the retard member a different portion of the friction surface engages the feed member.

Preferably the selective drive means includes an input drive shaft and means drivingly connecting the stack support means to the shaft, and the retard member incremental moving means includes means for drivingly connecting the retard member to the drive shaft.

Preferably the means for drivingly connecting the retard member to the shaft comprises: a rotatable shaft for supporting the retard member, an eccentric cam supported about the input drive shaft, and a connecting arm having a follower portion for engaging the cam and being connected to the retard member support shaft through a first one-way clutch. Rotation of the input drive shaft causes the connecting arm to oscillate and the one-way clutch converts the oscillatory motion to rotation in a single direction.

Accordingly, it is an object of the present invention to provide an improved friction retard sheet feeding apparatus.

It is a further object of this invention to provide a sheet feeding apparatus as above including a means for incrementally advancing a retard member.

It is a further object of this invention to provide a sheet feeding apparatus as above wherein, the incrementing means provides non-uniform incrementation.

It is a further object of this invention to providde a sheet feeding apparatus as above wherein, the incrementing means is responsive to the operation of a stack elevating apparatus.

It is a still further object of this invention to provide a reproducing apparatus employing the aforenoted sheet feeding apparatus.

These and other objects will become more apparent from the following description and drawings.

DETAILED DESCRIPTION OF THE PREFERRED EMBODIMENTS

Figure 1:
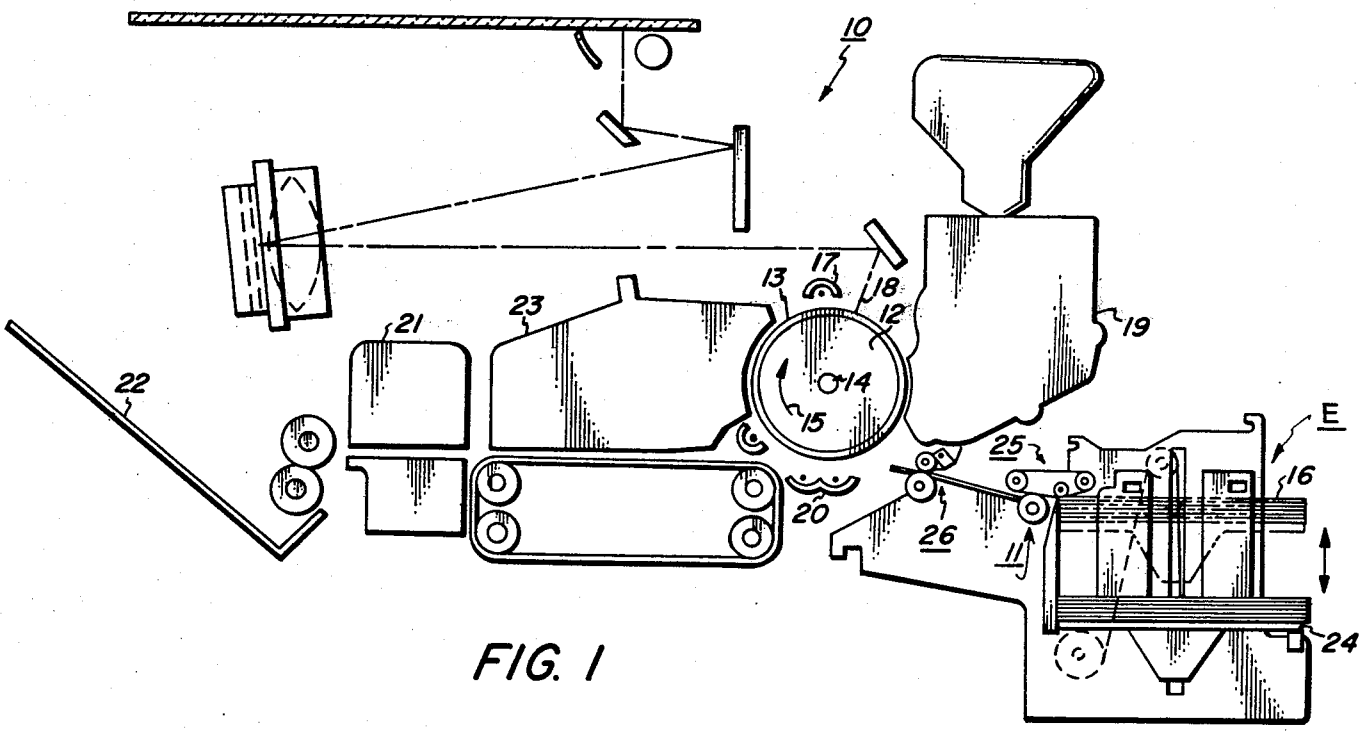
FIG. 1 is a front schematic view of a reproducing apparatus in accordance with the present invention.

Referring now to FIG. 1 there is shown by way of example an automatic xerographic reproducing machine 10 which incorporates the retard member incrementing apparatus 1 of the present invention. The reproducing machine 10 depicted in FIG. 1 illustrates the various components utilized therein for producing copies from an original. Although the apparatuses 11 of the present invention are particularly well adapted for use in an automatic xerographic reproducing machine 10, it should become evident from the following description that they re equally well suited for use in a wide variety of processing systems including other electrostatographic systems and they are not necessarily limited in their application to the particular embodiment or embodiments shown herein.

The reproducing machine 10 illustrated in FIG. 1 employs an image recording drum-like member 12, the outer periphery of which is coated with a suitable photoconductive material 13. One type of suitable photoconductive material is disclosed in U.S. Pat. No. 2,970,906, issued to Bixby in 1961. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

The practice of xerography is well known in the art and is the subject of numerous patents and texts including *Electrophotography* by Schaffert, published in 1965, and *Xerography and Related Processes* by Dessauer and Clark, published in 1965.

Initially, the drum 12 moves the photoconductive surface 13 through a charging station 17. In the charging station 17, an electrostatic charge is placed uniformly over the photoconductive surface 13 preparatory to imaging. The charging may be provided by a corona generating device of the type described in U.S. Pat. No. 2,836,726, issued to Vyverberg in 1958.

Thereafter, the drum 12 is rotated to exposure station 18 wherein the charged photoconductive surface 13 is exposed to a light image of the original input scene information whereby the charage is selectively dissipated in the light exposed regions to record the original input scene in the form of a latent electrostatic image. A suitable exposure system may be of a type described in U.S. Pat. No. 3,832,057 issued to Shogren in 1974. After exposure drum 12 rotates the electrostatic latent image recorded on the photoconductive surface 13 to development station 19 wherein a conventional developer mix is applied to the photoconductive surface 13 of the drum 12 rendering the latent image visible. A suitable development station is disclosed in U.S. Pat. No. 3,707,947, issued to Reichart in 1973. That patent describes a magnetic brush development system utilizing a magnetizable developer mix having coarse ferromagnetic carrier granules and toner colorant particles. The developer mix is brought through a directional flux field to form a brush thereof. The electrostatic latent image recorded on the photoconductive surface 13 is developed by bringing the brush of developer mix into contact therewith.

Sheets 16 of final support material are supported in a stack arrangement on an elevating stack support tray 24. With the stack at its elevated position (shown in phantom) a sheet separator 25 feeds individual sheets therefrom to the registration system 26. The sheet is then forwarded to the transfer station 20 in proper registration with the image on the drum. The developed image on the photoconductive surface 13 is brought into contact with the sheet 16 of final support material within the transfer station 20 and the toner image is transferred from the photoconductive surface 13 to the contacting side of the final support sheet 16. The final support material may be paper, plastic, etc., as desired.

After the toner image has been transferred to the sheet of final support material 16 the sheet with the image thereon is advanced to a suitable fuser 21 which coalesces the transferred power image thereto. One type of suitable fuser is described in U.S. Pat. No. 2,701,765, issued to Codichini et al. in 1955. After the fusing process the sheet 16 is advanced to a suitable output device such as tray 22.

Although a preponderance of the toner powder is transferred to the final support material 16, invariably some residual toner remains on the photoconductive surface 13 after the transfer of the toner powder image to the final support material. The residual toner particles remaining on the photoconductive surface 13 after the transfer operation are removed from the drum 12 as it moves through a cleaning station 23. The toner particles may be mechanically cleaned from the photoconductive surface 13 by any conventional means as, for example, the use of a blade as set forth in U.S. Pat. No. 3,740,789, issued to Ticknor in 1973.

It is believed that the foregoing description is sufficient for purposes of the present application to illustrate the general operation of an automatic xerographic copier 10 which can embody the apparatus 11 in accordance with the present invention.

Referring now to FIGS. 2–5, the sheet feeder 25 and retard member incrementing apparatus 11 in accordance with the present invention will be described in greater detail. The sheet feeder 25 is similar in some respects to the one described in U.S. Pat. application Ser. No. 503,413, filed September 5, 1974, now U.S. Pat. No. 3,949,979 to Taylor et al., in that a friction feed belt 30 is arranged to be pivoted against the stack to feed the uppermost sheet 16 to the registration system 26. A retard roll 31 is utilized which is held stationary during sheet feeding. The roll 31 engages the feed belt 30 in an unsupported region to form a nip therebetween for the passage of the sheets 16. The belt feeder and roll type retard member are arranged to be pivoted on a nipped unit.

The normal force necessary for sheet feeding may be provided by means of a pick force generated upon operation of the feeder as in the above-noted Taylor et al. application. The pick force is a function of the nip friction between the retard roll and the belt feeder.

A sheet 16 which is fed from the stack is advanced to the registration system 26 comprising pivoting gate 32 and registration pinch rolls 33 and 34 which synchronize it with the image on the drum. The registration gate 32 is pivotally arranged so that the sheet may be buckled against the gate and then guided into the nip of the registration rolls 33 and 34 for advancement to the drum for image transfer. Further details of the registration gate and roll arrangement 36 shown can be found in the aforenoted Taylor et al. application.

In the Taylor et al. application, the stack of sheets to be fed is supported upon a movable drawer arrangement. While this approach is quite useful for the purposes described, it has been found desirable to provide a larger sheet supply to increase the time interval before the reloading of sheets into the machine is required. A sheet supply capacity of one or more reams is desirable.

In accordance with the present invention the sheet supply system includes a stack elevating apparatus E which enables the supply system to accommodate one or more reams of paper. By using an elevator mechanism E for lifting a large stack against the pivoting feeder 25 the arc through which the feeder travels for feeding can be maintained within acceptable limits.

Figure 2:
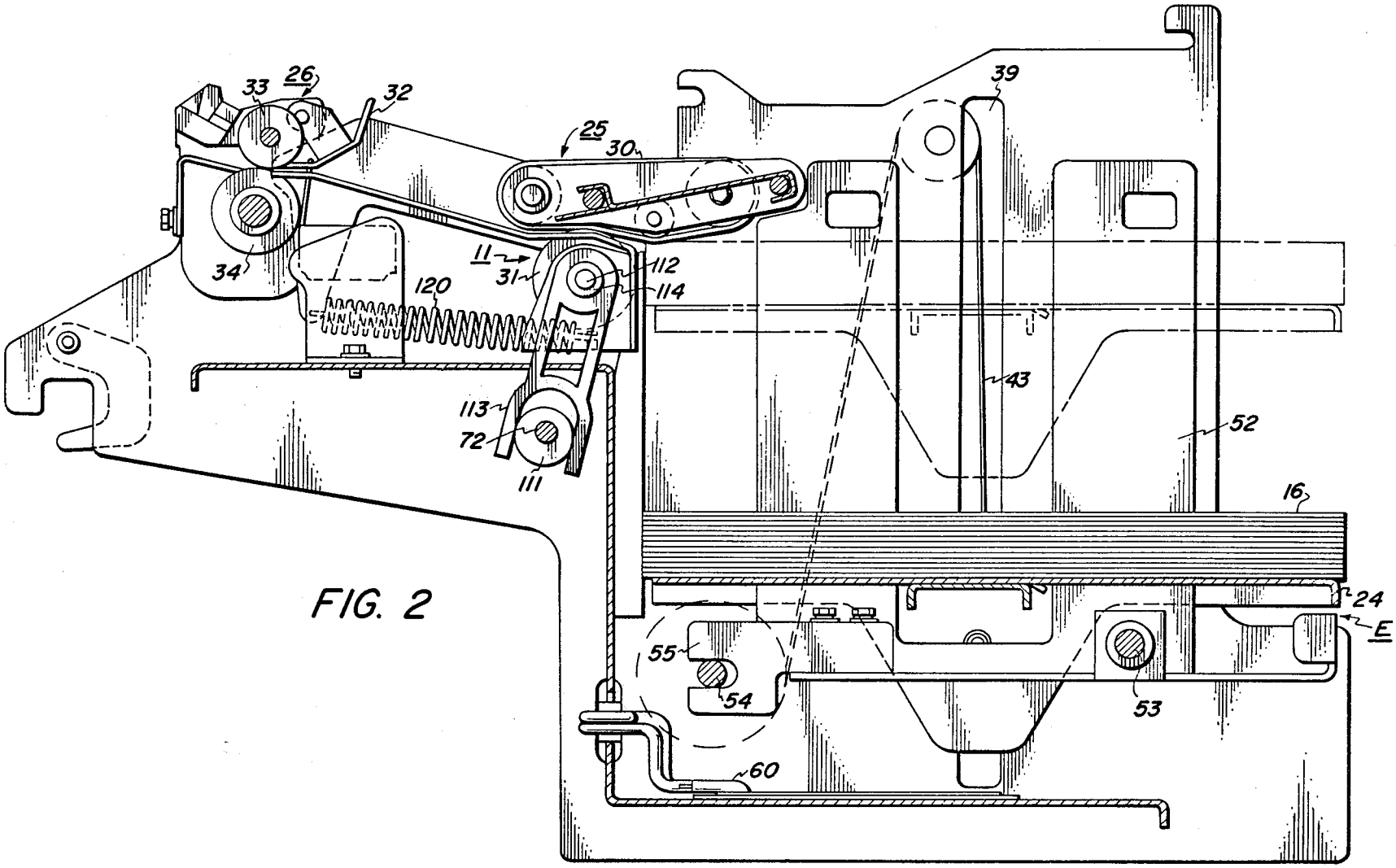
FIG. 2 is a sectional view of the stack elevating and sheet feeding apparatus of FIG. 1.

The stack of sheets as shown in FIG. 2 is supported upon a tray-like member 24. The tray 24 is arranged for movement in a generally vertical direction between an elevated sheet feeding position (shown in phantom) wherein the top sheet 16 in the stack engages the feed belt 30 and a lowered position (shown in solid lines) for loading and unloading the sheets therefrom. The elevator tray 24 is supported between the front 36 and rear 37 side frames of the apparatus E. Vertically extending slots 38 and 39 are provided in the side frames 36 and 37. Elongated rectangular tabs 40 and 41 secured to the elevator tray 24 ride in those slots for the purposes of guiding the tray as it is moved up and down and for preventing the tray from tilting longitudinally of the sheet feeding direction.

Two cables 42 and 43, one at each side, are attached to the tray 24 for providing connection between the tray and the elevating drive mechanism 50. One end of each cable 42 and 43 is connected to the respective tray tabs 40 and 41. The other end of each cable 42 or 43 is supported about a respective idler pulley 44 or 45 and then connected to a respective capstain 46 or 47 about which it is wound or unwound in order to raise or lower the tray.

In order to properly locate the stack of sheets 16 on the tray 24 for sheet feeding, a stationary side guide member 51 and a movable side guide member 52 is provided. The movable side guide 52 allows adjustment for different sheets lengths. For example, in the apparatus described the sheets are fed with their long edge perpendicular to the sheet feeding direction. Therefore, for 8½ × 11 sheets the side guides 51 and 52 would be spaced closer together than for 8½ × 14 sheets. The movable side guide 52 is slidingly supported on a first rod 53 which also acts as a frame member and a second shaft 54 which also supports the capstains 46 and 47. A fork-type coupling 55 is utilized to couple the guide 52 to the capstain shaft 54. A leaf spring 56 is provided which is biased between the side guide member 52 and the support rod 53 for frictionally holding the side guide at its desired position. Front guide plates 57 are utilized to align the front edge of the stack for feeding.

The sheet feeding apparatus described is arranged for use with an edge registered machine and, thus, one edge guide 51 is fixed while the opposing edge guide 52 is movable to accommodate different paper sizes. If desired, however, other registration arrangements could be utilized including center registration wherein both guides 51 and 52 would be made movable to accommodate sheets of different sizes and the center line of each sheet of one size would correspond with the center line of each sheet of another size. Further, if desired, the sheet stack can be arranged with the long edge of the sheet parallel to the sheet feeding direction.

A paper tray heater 60 of conventional design may be utilized, if desired, to maintain the environment of the stack of sheets within proper humidity limits.

Attention will now be turned to the drive mechanism 50 for raising and lowering the tray 24. In accordance with the present invention the elevator tray is raised to tis elevated positions by means of a motor drive (not shown). Instead of utilizing a separate motor to elevate the tray, the drive motor which drives the other elements of the reproducing machine may, if desired, be utilized to provide the driving input to raise the elevator. Lowering of the elevator tray is by gravity, however, the rate of descent of the stack support tray is controlled by a means which preferably provides an inertial force.

Figure 4:
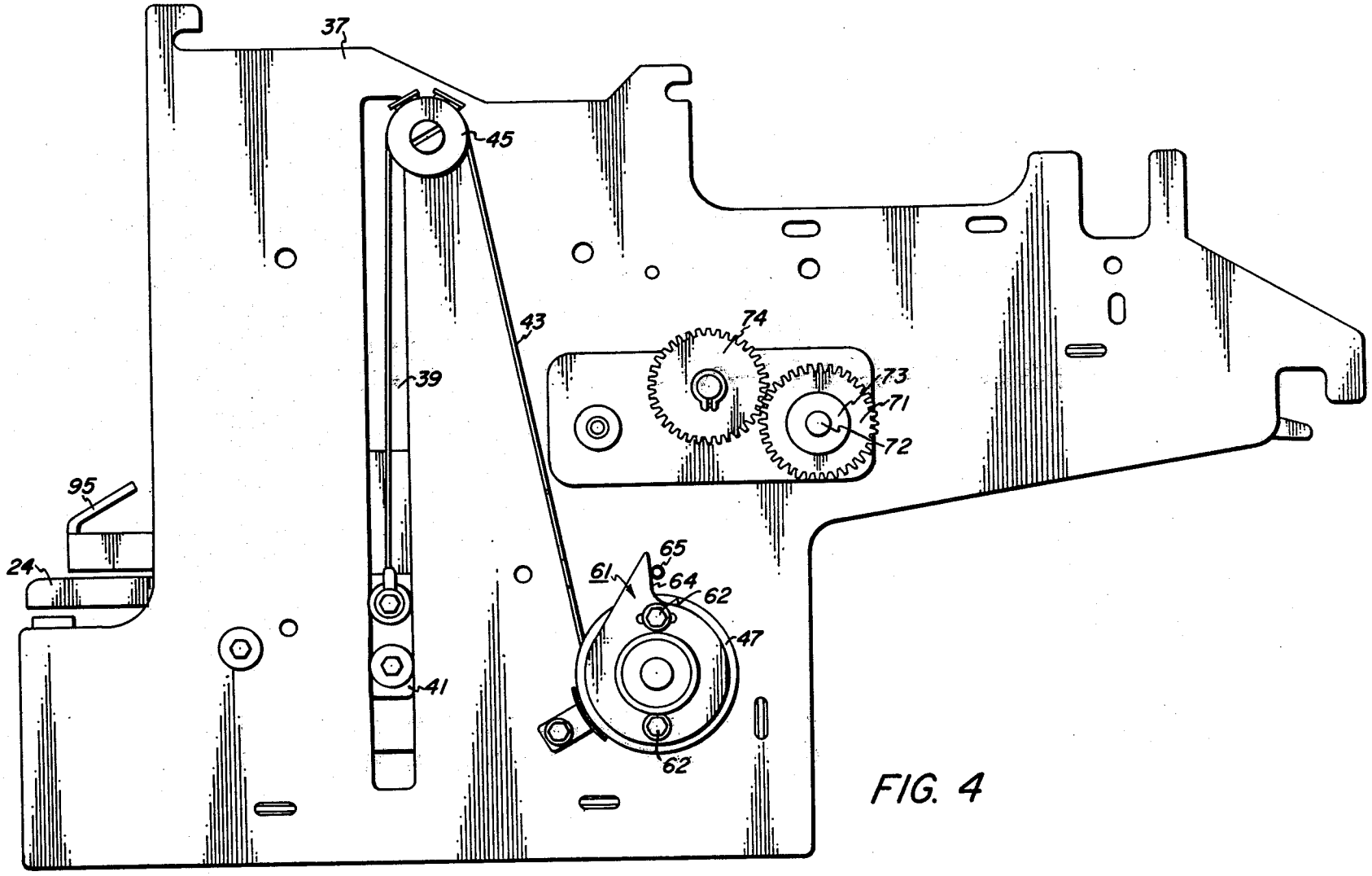
FIG. 4 is a rear view of the stack elevating and sheet feeding apparatus of FIG. 1.

The shaft 54 which supports the capstain 46 and 47 may be considered an input shaft to the cable lifting system. The lower limit or lowered position of the tray 24 is governed by the position of a stop member 61 supported by the rear capstain 47. Referring to FIG. 4, the stop member 61 is adjustably secured to the rear capstain 47 by two screws 62. A slot 63 associated with one of the screws 62 is provided to permit adjustment of the lowered tray position. The stop member includes a radially projecting stop face 64 which is arranged to intercept a pin 65 supported by the rear side frame 37. In this manner, as the elevator tray 24 is lowered by gravity, it is stopped at its lowered position when the stop face 64 intercepts the pin 65.

Figure 3:
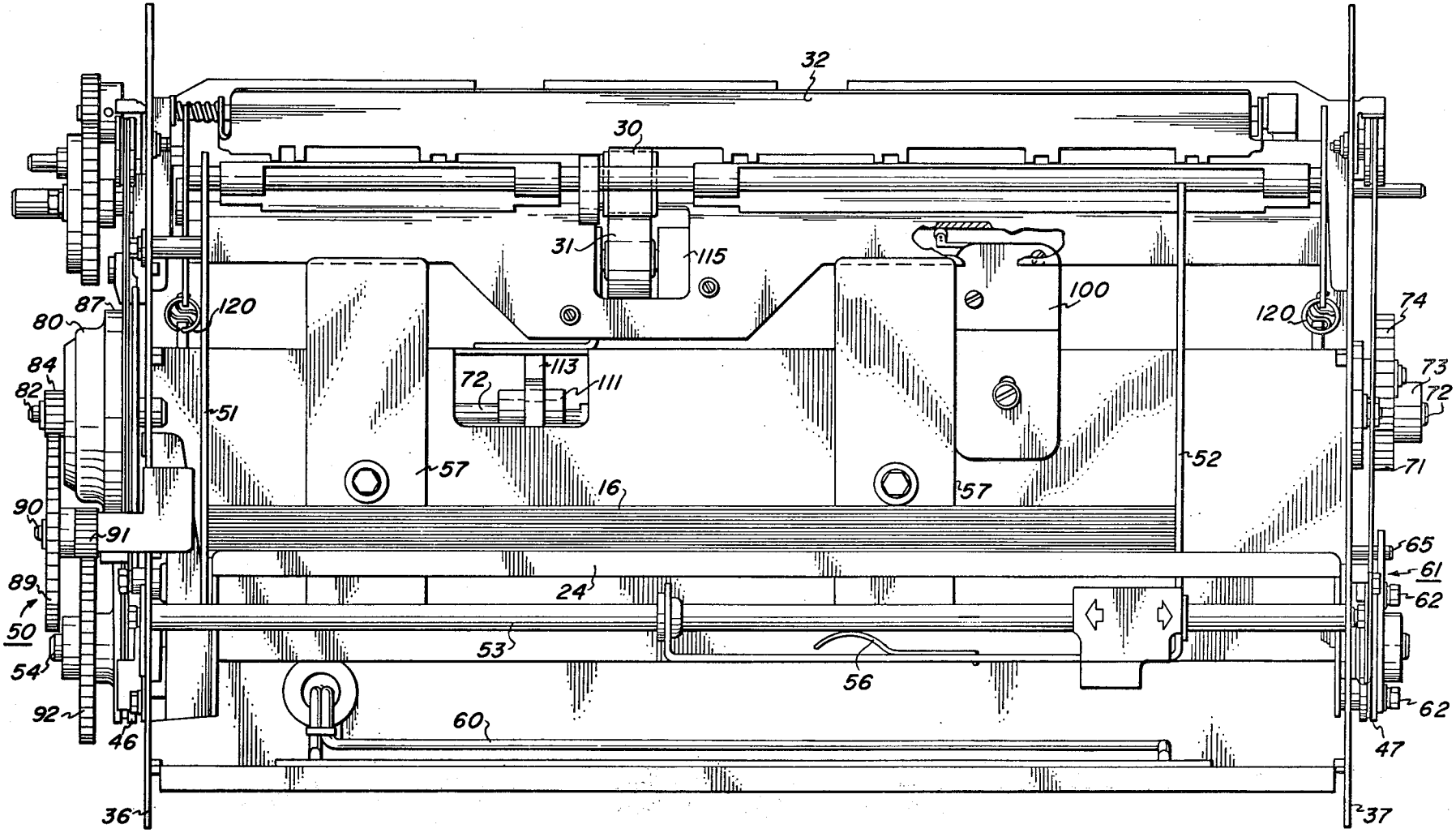
FIG. 3 is a side view of the stack elevating and sheet feeding apparatus of FIG. 1.
Figure 5:
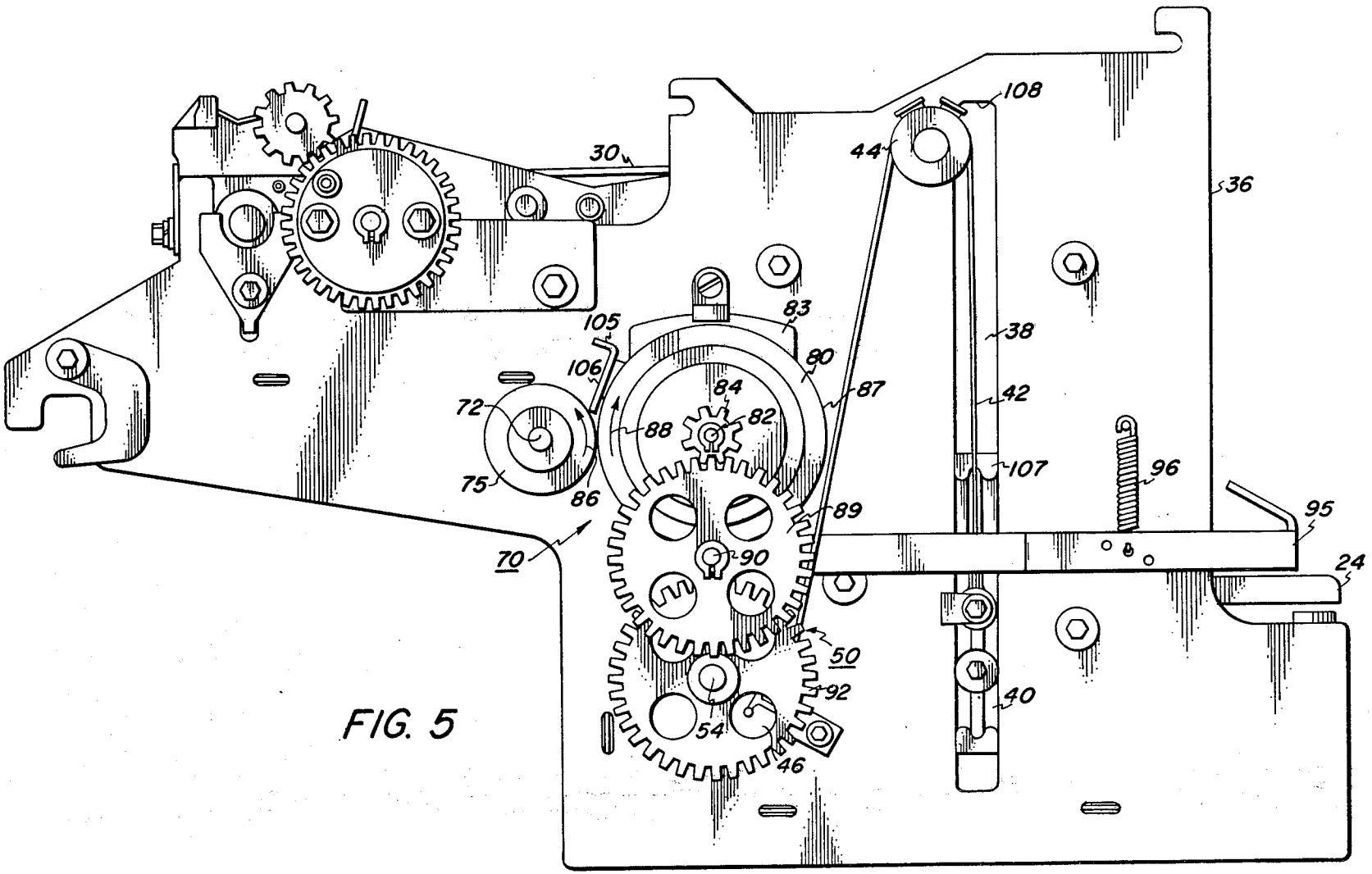
FIG. 5 is a front view of the stack elevating and sheet feeding apparatus of FIG. 1.

Raising of the elevator tray 24 is provided by means of a friction drive system 70, as shown in FIGS. 3–5. An input gear 71 is mouned to a drive shaft 72 by means of an electrically operated clutch 73. The drive 50 to the elevator mechanism can be taken from the main machine drive system through gear 74 and be made intermittent as required for sheet feeding by the clutch 73. The clutch 73 includes a friction member (not shown) which prevents rotation of the drive shaft 72 when the clutch is disengaged. The main drive system of the machine may be connected to the gear 74 by any desired means. The other end of the drive shaft 72 supports a friction wheel 75, which includes a material about its outer surface exhibiting high friction. The friction wheel 75 is pinned to the drive shaft which is journaled in the side frames 36 and 37.

An inertial member 80 is arranged to be selectively engageable with the friction wheel 75 in order to provide driving engagement for the cable 42, 43, and capstain 46, 47 elevating mechanism. The inertial wheel 80 is supported by a one-way roller bearing clutch 81, as in FIG. 6, upon a short shaft 82 which itself is journaled for rotation is a pivoting frame member 83. A gear 84 is pinned to the shaft 82. The drive provided by the friction wheel is in the direction shown by arrow 86. When the outer surface 87 of the inertial member 80 is in driving engagement with the friction wheel 75, it is rotated in the direction shown by arrow 88, and the roller clutch 81 engages it to the shaft 82. The gear 84 is arranged to mesh with larger diameter gear 89 secured to shaft 90 journaled in the side frame 83. A small diameter gear 91 is also secured to the shaft 90 and it is meshed with a large diameter gear 92 which is secured to the input shaft 54 supporting the drive capstains 46 and 47. The gearing arrangement comprising gears 84, 89, 91, and 92, provides for a substantial reduction ratio betwen the rate of rotation of the shaft 82 and the rate of rotation imparted to the capstain shaft 54. The use of a reduction mechanism such as the reduction gearing shown is highly desirable since it substantially reduces the input torque required for the friction wheel 75. The gear reduction also provides an amplification means for increasing the reflected inertia of the inertial member 80 imparted to the capstain input shaft 54.

The driving engagement between the inertial member 80 and the friction wheel 75 is selective. When it is desired to raise the tray 24, driving engagement is provided by the pivoting of the inertial wheel support plate 83 to the position shown in solid lines in FIG. 7. The support plate 83 includes an actuation arm 95. The plate is arranged to be pivoted into the normally "engaged drive" position by the biasing of spring 96. There is sufficient tolerance in the gears 91 and 92 such that the pivot point 97 for the support plate 83 need not be about the axis of the gear 91 in order to maintain meshing engagement. Displacing the pivot point 97 from the axis of gear 91, as shown, provides a small amount of inertial wheel 80 rotation or kick in the direction opposite to that of arrow 88 as the wheel is pivoted from its drivingly engaged position to its disengaged position.

Since the inertial wheel 80 and friction drives wheel 75 are normally engaged, elevation of the tray 24 is controlled when the main machine drives are operating by means of the input clutch 73, which couples the main machine drives to the drive shaft 72. In most machines the main machine drives begin to run when the start print switch is actuated. Therefore, the tray will automatically elevate from its lowered position through its engaged driving clutch 73 when the start print switch is actuated. Of course, conventional control means (not shown) will prevent a copy cycle from starting until the stack is ready for feeding. The input clutch 73 is controlled by means of an electrical switch 100 which is arranged to be actuated by the pivoting sheet separator 25. When the elevator tray 24 is in its lowered position, the clutch 73 engages the main machine drives to the shaft 72 so the elevator drive mechanism 50 raises the tray to an elevated position where the sheets 16 supported thereon pivot the feeder head 25 through a desired arc of travel. As the feeder 25 pivots up, the switch 100 changes its control state at which time the clutch is disengaged to stop the elevator. As sheets 16 are fed from the stack the feeder 25 will pivot down through its arc of travel and the switch will again change state and cause the elevator tray to be raised to increment the stack and pivot the feeder 25 to its uppermost position.

Figure 8:
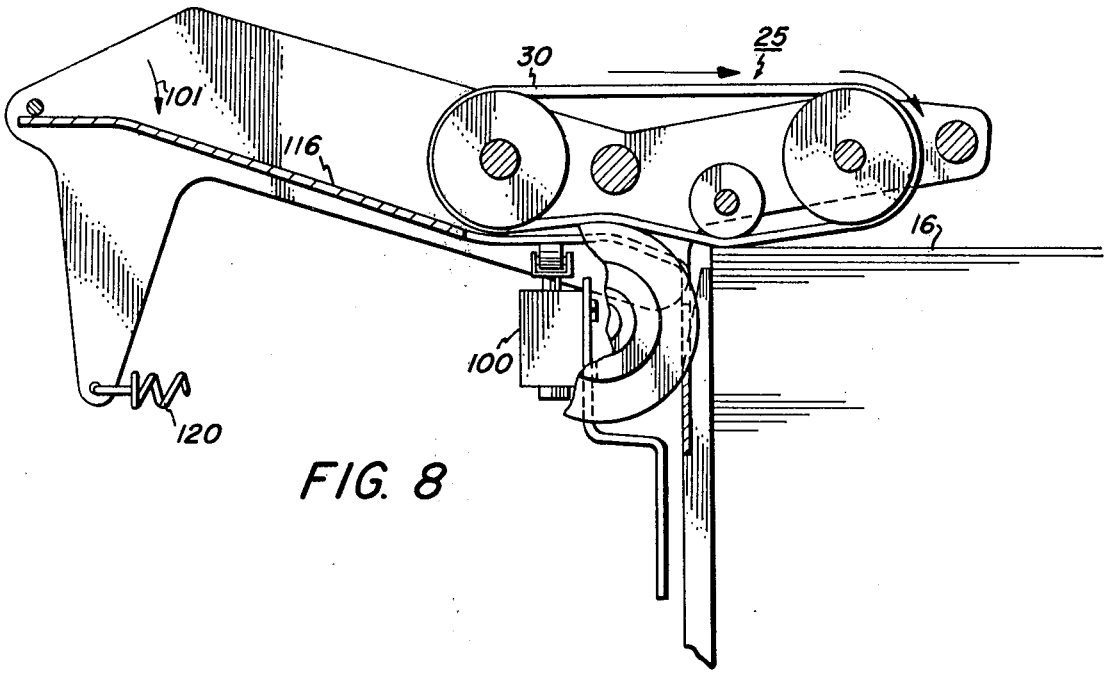
FIG. 8 is a partial sectional view of the sheet feeding apparatus.
Figure 9:
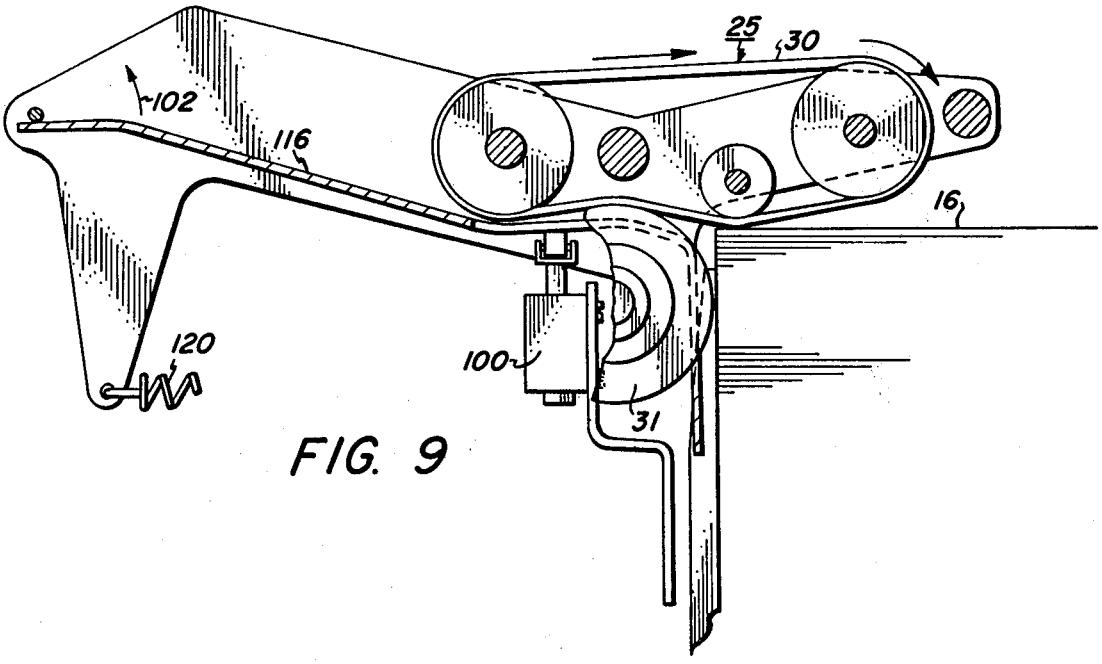
FIG. 9 is a partial sectional view of the sheet feeding apparatus.

In FIG. 8, the feeder 25 is shown in a stack depleted position wherein a number of sheets 16 have been fed from the stack and pivoted the feeder head in the direction of arrow 101. At this point the switch 100 changes its state and the input drive clutch 73 engages the machine drive system (not shown) to the drive shaft 72 to raise the stack, and thereby pivot the feeder 25 in the opposite direction of arrow 102 until, as shown in FIG. 9, the switch 100 is thrown to its opposite state and the input drive clutch 73 is disengaged. In this manner the elevator tray, after it is initially traversed from its lowered position to an elevated position placing the stack in operative engagement with the sheet feeder 23, will periodically raise the stack in increments as sheets are depleted therefrom.

Figure 6:
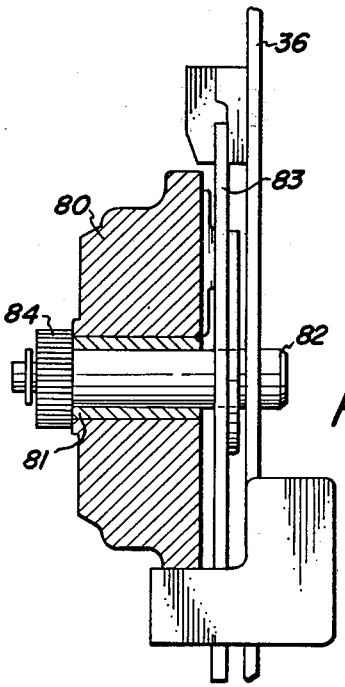
FIG. 6 is a partial cross-sectional view of an inertial force providing means.
Figure 10:
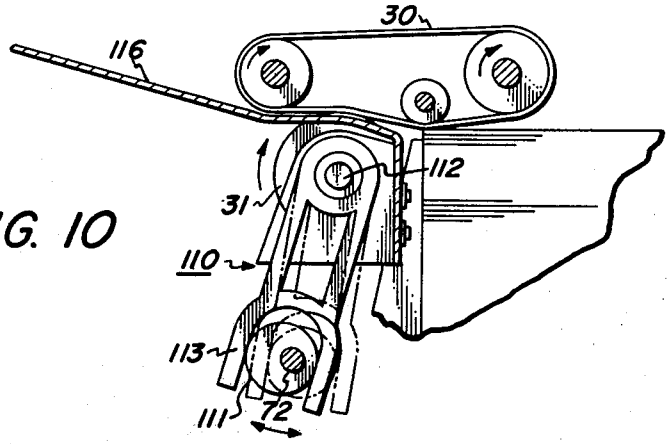
FIG. 10 is a partial cut-away view of the retard wheel advancing system.
Figure 11:
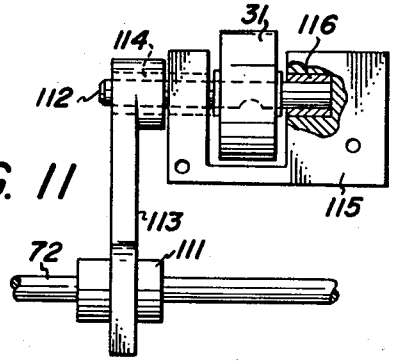
FIG. 11 is a front view of the retard wheel advancing system.
Figure 7:
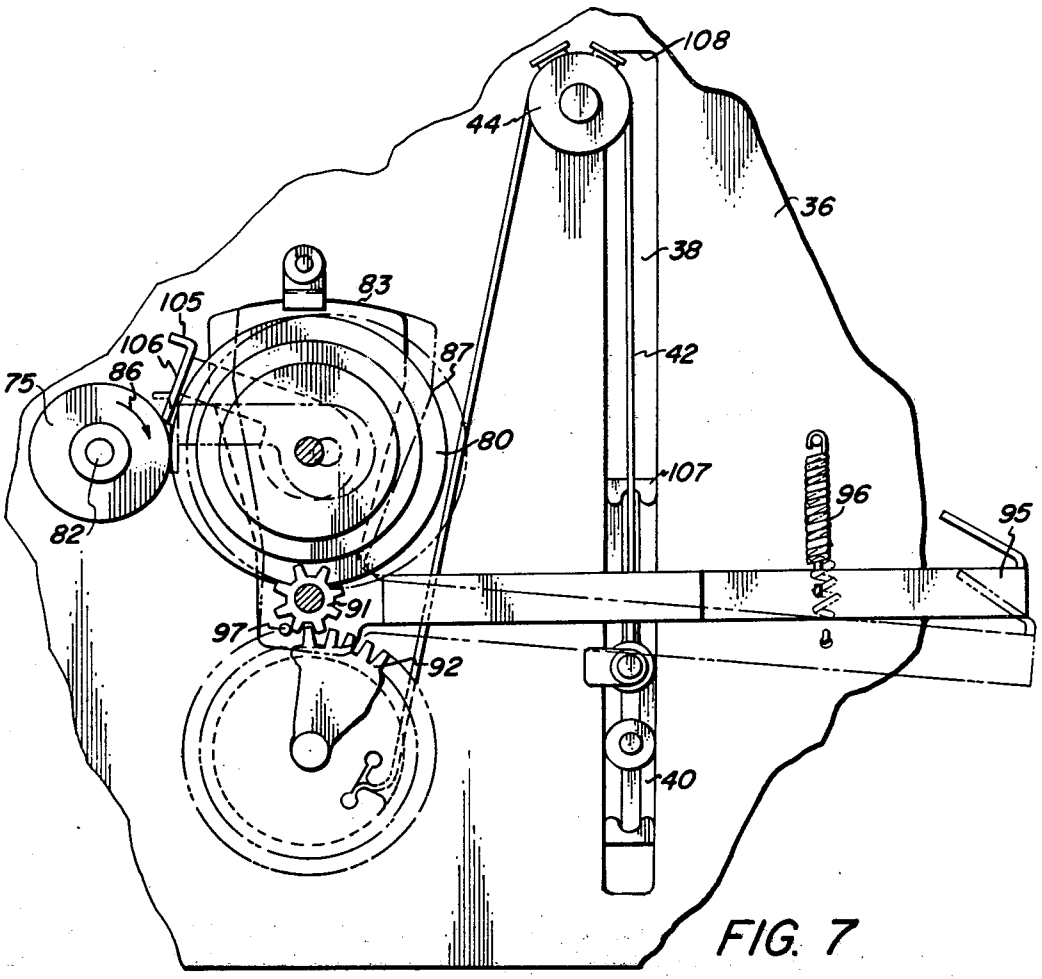
FIG. 7 is a partial view of the apparatus of FIG. 5 illustrating descent switch operation.

In order to lower the stack it is only necessary to push the arm 95 of the pivoting support plate 83 to the position as shown in phantom in FIG. 7. The effect is to disengage the inertial member 80 from the friction drive roll 75. The arm may be manually held in this position to lower the stack or in accordance with a preferred embodiment of this invention or interposer member 105 may be provided. The purpose of the interposer member 105 is to maintain the separation between the friction drive wheel 75 and inertial member 80 until it is desired to again raise the tray 24. Referring to FIG. 6, an interposer member 105 is pivotally supported about the shaft 82. The interposer member 105 pivots by gravity between the friction roll 75 and inertial member 80 when the arm 95 is depressed to the position shown in phantom. The interposer member 105 includes an L-shaped face 106 which is arranged to engage the friction wheel 75 when the arm 95 is released to maintain the desired spaced apart relationship of the friction drive wheel and the inertial member. After a new stack has been loaded and the start print switch (not shown) is actuated, the switch 100 will cause the input drive clutch 73 to be engaged to the shaft 72 and rotate the drive wheel 75. This will automatically pivot the interposer member 105 out of its position between the drive wheel and the inertial member. The pivoting support plate 83 will then pivot the inertial member 80 into engagement with the drive wheel 75 to raise the stack to its desired level as previously described.

It is preferred, in accordance with this invention, to utilize an interposer arrangement 100 so that it is not necessary for the operator to maintain pressure on the release arm. If desired, the interposer member 100 need not be employed and the operator would continuously depress the release arm 95 until the elevator descended to its lowered position.

One purpose of the inertial member 80 and of the gear train 50 is to control the rate of descent of the stack support tray. The inertial member, as described, also serves as a selectively engageable drive coupling. In order to provide the desired inertial effect, it should have a substantial mass as shown. While this embodiment is being described with reference to the use of a friction drive system which provides advantages as will be described later, if desired, the input drive wheel 75 could comprise a gear and similarly the inertial member could comprise a gear of substantial mass. Other well known drive coupling methods could also be employed. The inertial member, if desired, need not be part of the input drive coupling arrangement. For example, the drive from shaft 72 could be coupled to the shaft 54 without going through the inertial member 80 and amplifying reduction gearing 50. In this case, the inertial member 80 and gears 50 would be associated with the shaft 54 at its end supporting capstan 47.

The use of a friction drive system is advantageous because in the event of a failure of the stack level control switch 100, the elevator tray upon reaching its end of travel position would stop and do not damage to the sheet feeder. Even if the wheel 75 continued to rotate it would merely slip against the wheel 80 because of the frictional engagement. To further insure failsafe operation, the tab 40 of the tray 24 which is supported in the guide slot 38 of the front side member 36 includes an upper portion 107 which is arranged to engage the upper end 108 of the slot to prevent movement of the tray above a desired height. This, in conjuction with the frictional drive arrangement, operates as a failsafe mechanism to prevent the paper elevator from being overdriven due to a failure in the control system.

In the system which has been described thus far, if the operator wants to lower the stack the release arm 95 is depressed which operates as described above to disengage the inertial member 80 and drive train 50 from the input drive. This allows the tray 24 to fall by gravity. However, the rate of fall is controlled by the high reflected inertia of the inertial member 80 and gear train 50. Since the weight of the tray and the stack of sheets thereon is approximately inversely proportional to the tray height, the amount of energy that is transferred to the inertial member 80 during free fall will tend to be relatively constant. Thus, by use of the inertial control system herein the time interval for descent of the elevator mechanism will not vary widely. A descent time of about two seconds can be achieved for a drop of as much as about 4 inches by the tray 24.

Therefore, it is apparent that upon disengagement of the friction drive, the support tray 24 and the stack supported thereon fall under the force of gravity and cause the inertial member 80 and associated gear train 50 to rotate in a direction opposite to the drive direction. The inertial member 80 will accelerate and can reach in view of the reduction ratios employed in the reduction gearing 50, a high speed. For example, for gearing 50 having a reduction ratio of about 24:1 the inertial member can accelerate to as much as 1500 revolutions per minute or more. When the elevator tray 24 reaches its lower position the capstan 46 and 47 and the gears 84, 89, 91, and 92 connected thereto must stop short. Since the inertial wheel is traveling at such a high speed if it also had to stop short, there would be a substantail torque imposed upon the gearing 50 which could damage them and the sheet feeding apparatus.

In accordance with one embodiment of the present invention the one-way roller clutch and bearing assembly 81 is used to mount the inertial member 80 to the shaft 82. This allows the inertial member to continue to spin after tray 24 has stopped at its lowered position. This removes the substantial torque which would otherwise be applied to the gear train 50. The inertial wheel will eventually come to rest and even if it does not, re-engagement with the friction drive wheel 75 will cause it to stop and rotate in the driving direction to raise the elevator tray.

A suitable roller clutch and bearing assembly is made by the Torrington Company, Torrington, Connecticut, 06790, as their Part Number RCB-061014. See also U.S. Pat. Nos. 3,184,020 and 3,194,368.

While the invention has thus far been described by reference to the use of a one-way clutch 81 for mounting the inertial member 80 to its support shaft 82, if desired, the one-way clutch could be utilized in mounting one of the gears 84, 89, 91, and 92 associated with the inertial member to its respective support shaft. For example, if the gear 92 supported by the capstan shaft 54 were mounted thereto by means of the one-way roller clutch 81 described, then the gears 84, 89, 91, and 92, as well as the inertial member 80 would continue to rotate after the tray had reached its lowered position. It is preferred in accordance with this embodiment to provide some means for allowing the inertial member to continue to rotate after the tray has stopped.

While the tray is falling, the inertial wheel 80 continues to be engaged to its shaft 82, even though it is rotating in the opposite direction to arrow 88. The one-way clutch 81 disengages the wheel from the shaft 82 only after the shaft has stopped. Effectively the inertia of the wheel maintains the clutch in engagement with the shaft until free-wheeling occurs upon the stopping of the shaft.

The sheet feeder 25 of this invention utilizing as it does, a roll-type retard member 31 also includes a means for incrementing the roll to change the portion of the roll surface nipped with the feed belt 30. The incrementing mechanism for the retard roll provides for non-uniform incrementing of the roll surface relative to the feed belt nip. This should more evenly distribute the wear about the roll surface as compared to more conventional systems wherein the roll or other retard device is incremented a desired amount periodically.

It is the unique feature of the retard roll incrementing apparatus of this invention that it is keyed to the elevator 24 drive system. The amount of roll incrementation is a function of the amount of drive imparted to the elevator 24. Therefore, a large increment of roll movement will occur when the tray 24 is first raised from its reloading position and smaller increments will occur as the stack is depleted and the tray incrementally raised to compensate therefor. Therefore, the increments of roll movement will vary depending on whether it is being moved in response to reloading of the tray or stack deplation. This random incrementing of the roll surface should provide improved wearing of the surface.

The drives for incrementing the roll 31 are taken from the input drive shaft 72. The incrementing mechanism 110 includes a cam 111 eccentrically supported upon the shaft 72. The retard roll 31 is supported upon shaft 112. An oscillating arm 113 is connected between the retard roll shaft and the eccentrically mounted cam 111. The oscillating arm 113 is mounted to the retard roll shaft 112 by a one-way clutch 114 so that the shaft is advanced in only one direction even though the arm oscillates in two directions. The other end of the arm includes a fork-like follower arrangement for engaging the cam. Rotation of the cam 111, therefore, causes the arm 113 to oscillate up and back. The roll is incrementally moved counter to the direction of sheet feed.

A fork-like member 115 supported by the pivoting feeder support frame 116 includes a bearing for journalling the shaft 112 in one leg of the fork, and a second one-way clutch 117 for journalling an end of the shaft in the other leg of the fork. This second one-way clutch 117 serves to prevent rotation of the roll shaft and the roll pinned thereto in the sheet feeding direction.

It has previously been pointed out that the sheet feeder comprising the feed belt and retard roller pivot as a nipped unit. The feeder head itself is counterbalanced by means of a spring 120 in order to provide the desired pick force type sheet feeding arrangement as described above. The fork-type follower end of the oscillating arm 113 allows for this pivoting movement without losing engagement between the follower surfaces and the cam 111.

While the separator 25 has been described by reference to the use of a roll-type retard member 31, a pad, web, or belt-type retard member as in U.S. Pat. No. 3,768,803 to Stange could be employed. The incrementing apparatus 110 could be used just as well with a web or belt-type retard member.

While the elevator has been described by reference to the use of a start print switch to initiate raising after reloading, if desired, a separate switch could be provided to initiate raising as in various commercial copiers such as the Xerox 7000 copier.

Another feature of the sheet feeder of this invention is that the retard roll in the arrangement described above free-wheels when a sheet is being removed from the machine in the direction opposite to sheet feeding. This makes it very easy to clear a sheet which is shingled in the separator.

The texts, patents and patent applications set forth above are intended to be incorporated by reference into this application.

It is apparent that there has been provided in accordance with this invention an apparatus which fully satisfies the objects, means and advantages set forth hereinbefore. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A sheet feeding apparatus comprising:

friction retard means for feeding sheets from a stack thereof, said feeding means including a feed member for engaging said stack and a retard member having a friction surface arranged to engage said feed member to form a nip through which said sheets are fed;

means for supporting said stack of sheets for movement between at least one elevated position and a lowered position;

means for selectively driving said stack support means to said elevated position;

means responsive to the operation of said selective driving means for incrementally moving said retard member relative to said feed member;

whereby upon movement of said retard member a different portion of said friction surface engages said feed member.

2. An apparatus as in claim 1, wherein said selective drive means includes an input drive shaft and means drivingly connecting said stack support means to said shaft, and wherein said retard member incremental moving means includes means for drivingly connecting said retard member to said drive shaft.

3. An apparatus as in claim 2, wherein said means for drivingly connecting said retard member to said shaft comprises: a rotatable shaft for supporting said retard member, an eccentric cam supported about said input drive shaft, and a connecting arm having a follower portion for engaging said cam, and a portion connected to said retard member support shaft through a first one-way clutch, whereby rotation of said input drive shaft causes said connecting arm to oscillate and said one-way clutch converts said oscillatory motion to rotation in a single direction.

4. An apparatus as in claim 3, wherein said one-way clutch is arranged so that the direction of rotation of said retard member support shaft is counter to the direction of sheet feeding.

5. An apparatus as in claim 4, further including frame means for pivotally supporting against said stack said nipped feed member and retard member.

6. An apparatus as in claim 5, further including a second one-way clutch connected between said pivoting frame and said shaft supporting said retard member and arranged to prevent rotation of said shaft in the sheet feeding direction, whereby during sheet feeding said retard member does not move in the sheet feeding direction.

7. An apparatus as in claim 6, wherein said feed member comprises a belt and wherein said retard member comprises a roll arranged to engage said belt in an unsupported region.

8. An apparatus as in claim 7, wherein said sheet feeding apparatus comprises part of a reproducing machine further including, means receiving said sheets which are fed for forming an image thereon.

9. An apparatus as in claim 8, wherein said reproducing machine comprises an electrostatographic reproducing machine annd wherein said imaging means includes a movable imaging surface; means for forming an electrostatic image on said surface; means for developing said electrostatic image to render it visible; and means for transferring said visible image to said sheet.

* * * * *